US005440854A

United States Patent [19]

Hohmann

[11] Patent Number: 5,440,854

[45] Date of Patent: Aug. 15, 1995

[54] VENEER STRUCTURAL ASSEMBLY AND DRYWALL CONSTRUCTION SYSTEM

[75] Inventor: Ronald P. Hohmann, Syosset, N.Y.

[73] Assignee: Hohmann Enterprises, Inc., Hauppauge, N.Y.

[21] Appl. No.: 149,708

[22] Filed: Nov. 9, 1993

Related U.S. Application Data

[63] Continuation of Ser. No. 31,014, Mar. 11, 1993, abandoned, which is a continuation of Ser. No. 793,501, Nov. 15, 1991, and Ser. No. 399,074, Aug. 28, 1989, abandoned.

[51] Int. Cl.[6] ..... E04B 9/00

[52] U.S. Cl. ..... 52/489.1; 52/508; 52/379

[58] Field of Search ..... 52/508, 509, 713, 714, 52/660, 477, 488, 489, 490, 378, 379

[56] References Cited

U.S. PATENT DOCUMENTS

| | | | |
|---|---|---|---|
| 1,241,885 | 10/1917 | Roeder | 52/714 |
| 2,281,951 | 5/1942 | Schroeder | 52/477 X |
| 2,369,100 | 2/1945 | Young . | |
| 2,553,363 | 5/1951 | Droeger | 52/490 X |
| 3,370,391 | 2/1968 | Dupuis et al. | 52/488 X |
| 3,412,515 | 11/1968 | Finon | 52/488 X |
| 3,535,846 | 10/1970 | Storch | 52/509 X |
| 4,021,990 | 5/1977 | Schwalberg | 52/479 |
| 4,145,859 | 3/1979 | Ollinger | 52/735 X |
| 4,223,505 | 9/1980 | Krebel et al. | 52/714 |
| 4,373,314 | 2/1983 | Allan | 52/714 X |
| 4,596,102 | 6/1986 | Catani et al. | 52/508 |
| 4,598,518 | 7/1986 | Hohmann | 52/714 X |
| 4,827,684 | 5/1989 | Allan | 52/714 X |
| 4,922,680 | 5/1990 | Kramer et al. | 52/713 |

*Primary Examiner*—Lanna Mai

*Attorney, Agent, or Firm*—Lackenbach Siegel Marzullo Aronson & Greenspan

[57] ABSTRACT

A multi veneer anchor structural assembly for interconnection between the inner wythe and the outer wythe of an edifice. The assembly includes a pair of base members mounted in spanning relationship with at least vertical channels which form the frame of an edifice. A vertical plate is connected between the base members and has formed thereon a plurality of outwardly projecting vertical members each of which is engagable with a wall tie; with the wall ties being connected to an outer wythe. The assembly forms part of a drywall construction system which includes an insulating strip disposed between adjacent ones of the vertical plates, thereby providing a complete insulating layer for the edifice. In an alternate embodiment, the vertical plate is fabricated with a plurality of locally deformed areas which results in a high degree of stiffness of the veneer anchor structural assembly.

33 Claims, 8 Drawing Sheets

INNER WYTHE
14
14
56
5
72
68
12
36
34
5
70
20
24
28
32
26
22
70
54
30
34
72
56
2
58
10
40
16
44
34
42
18
46
16
18
56
2
OUTER WYTHE 56
20
57
38
32
38
57
22
56

FIG. 9
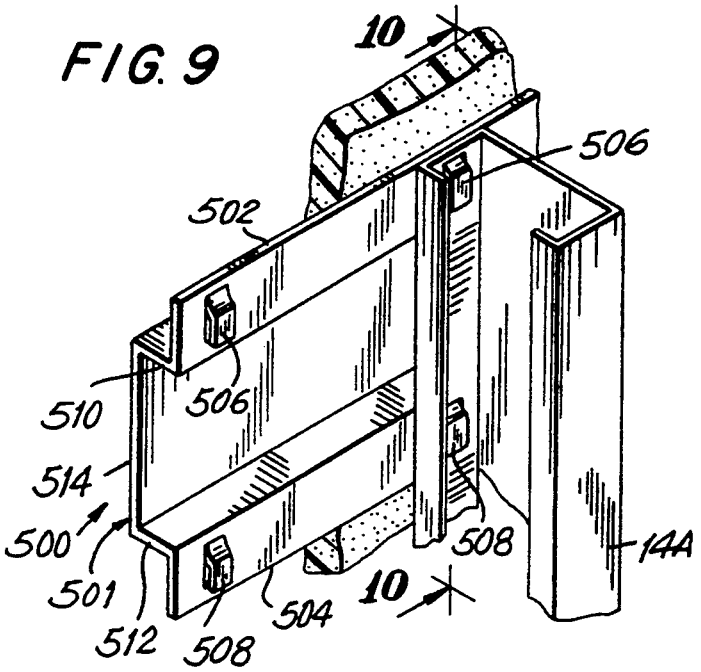
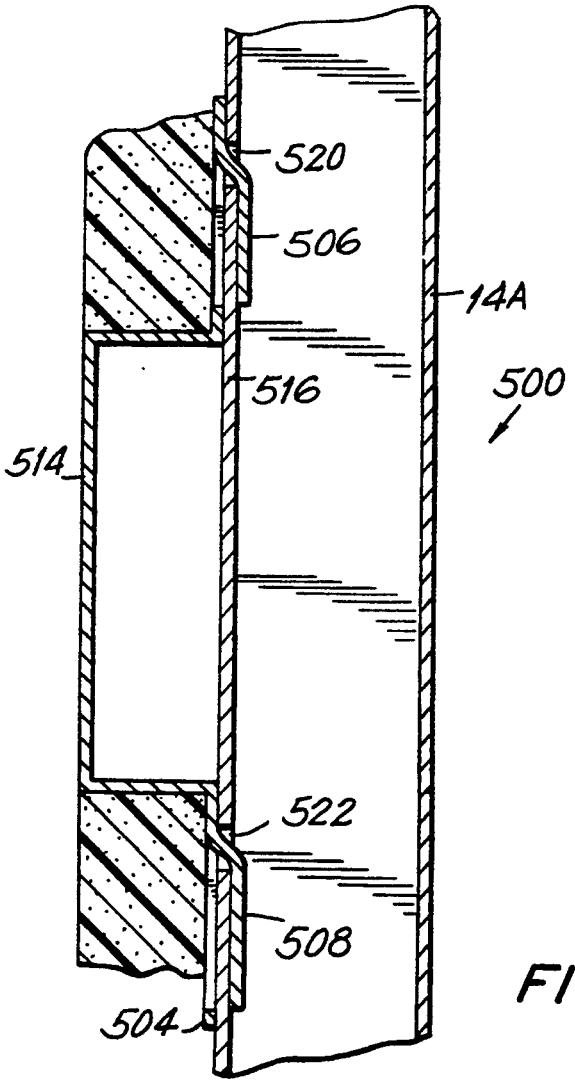
FIG. 10

FIG. 11
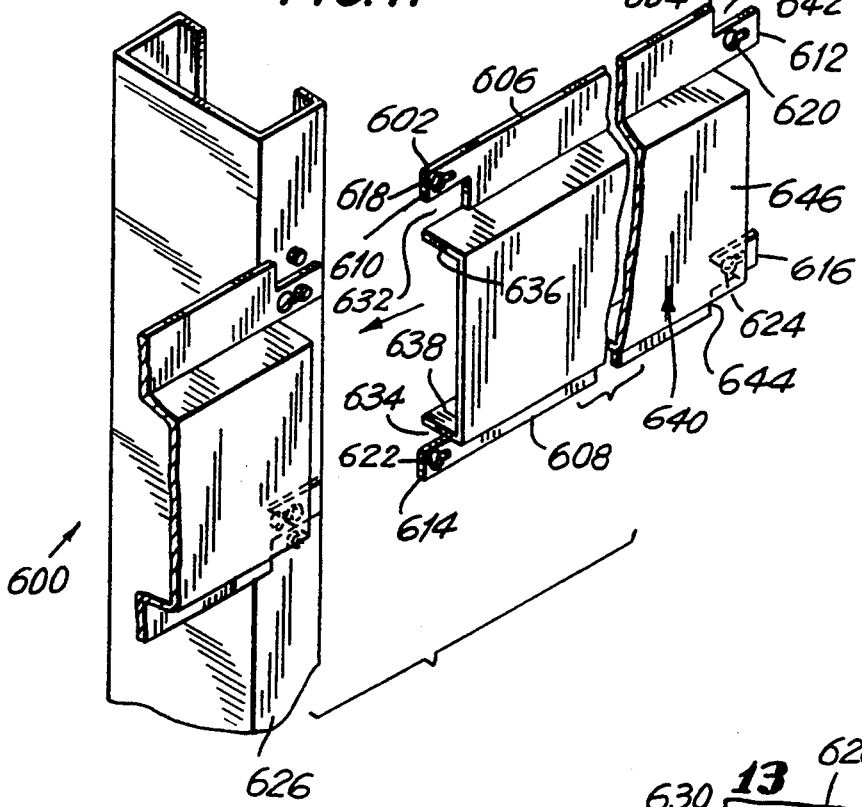
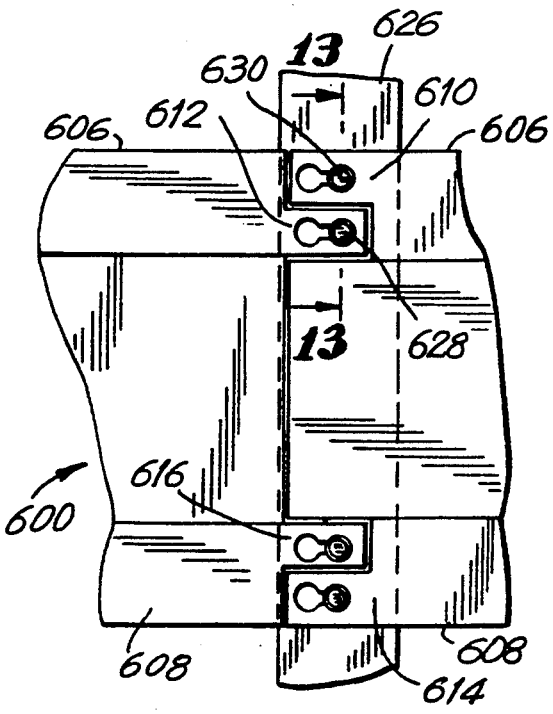
FIG. 12
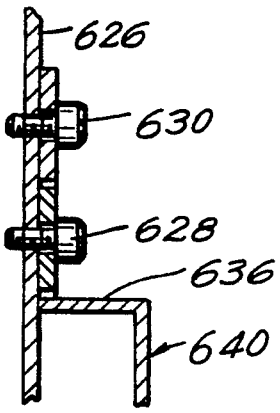
FIG. 13

VENEER STRUCTURAL ASSEMBLY AND DRYWALL CONSTRUCTION SYSTEM

This application is a continuation of application Ser. No. 08/031,014, filed Mar. 11, 1993 which is a continuation of Ser. No. 07/793,501; filed Nov. 15, 1991 and a continuation of Ser. No. 07/399,074; filed Aug. 28, 1989.

BACKGROUND OF THE INVENTION

The prior art related to veneer drywall construction systems includes several examples of veneer anchors which are used to interconnect inner and outer wythes. Examples of this prior art may be seen in U.S. Pat. No. 4,021,990 and U.S. Pat. No. 4,598,518.

U.S. Pat. No. 4,021,990 shows a drywall construction system in which the veneer anchor has a plate member which includes a relatively narrow vertically projecting bar disposed parallel to the plate member. The veneer anchor is used to secure a wall board layer to a vertical channel, or standard framing member, by inserting sheet metal screws into bores formed in the plate member and fastening the sheet metal screws through the wall board and the vertical channel.

U.S. Pat. No. 4,598,518 shows a veneer anchor which includes a pair of pronged members which are forced through a wall board layer until the pronged members abuttingly engage the front flange of a vertical channel member. Thereafter, sheet metal screws are inserted into bores formed in the veneer anchor and fastened through the wall board layer and the front flange of the channel member.

In each of the above examples, the veneer anchor is attached to a single vertical channel and to a single wall tie member.

After the above described veneer wall anchors are attached to the vertical channels, the wall tie members, which are formed of wire and have a generally truncated triangular configuration, are connected to the veneer wall anchors by attaching the apex portions of the wall tie members to the projecting bar portions of the veneer wall anchors. The base portions of the wall tie members are then attached to an outer wythe by inserting the base portions of the wall tie members into the mortar joints of the outer wythe.

The disadvantages of the prior art include the possibility of limited stability of the wall anchors caused by possible compression, settling or disintegrating of the insulating or wall board layer and the problems caused by the piercing of the wall board layer by the sheet metal screws shown in U.S. Pat. No. 4,021,990 or the combination of sheet metal screws and the pronged members in U.S. Pat. No. 4,598,518.

SUMMARY OF THE INVENTION

It is the primary object of the present invention to provide a new and novel multi veneer anchor structural assembly for use in drywall systems.

It is another object of the present invention to provide a new and novel multi veneer anchor structural assembly for securement of a wall board or insulation layer with respect to a plurality of vertical channels or framing members of an edifice employing a drywall construction system.

It is a further object of the present invention to provide a new and novel multi veneer anchor structural assembly and drywall construction system which permits the rapid placement and securement of a wall board or insulating layer with respect to channels or framing members.

It is yet another object of the present invention to provide a multi veneer wall anchor structural assembly which can be easily fabricated in large quantities and rapidly installed resulting in a low unit cost.

BRIEF DESCRIPTION OF THE DRAWINGS

The foregoing and other objects, features and advantages of the present invention will become more apparent from the detailed description hereinafter considered in conjunction with/the drawings wherein:

FIG. 9 is a partial perspective view of still another alternative embodiment of the invention;

FIG. 10 is a cross-sectional view taken along the line 10—10 of FIG. 9;

FIG. 11 is a partial perspective view of another alternative embodiment of the invention;

FIG. 12 is a fragmentary front elevation view of the embodiment of the invention depicted in FIG. 11;

FIG. 13 is a cross-sectional view taken along the line 13—13 of FIG. 12;

DETAILED DESCRIPTION OF THE PREFERRED EMBODIMENTS

Figures 1, 5:
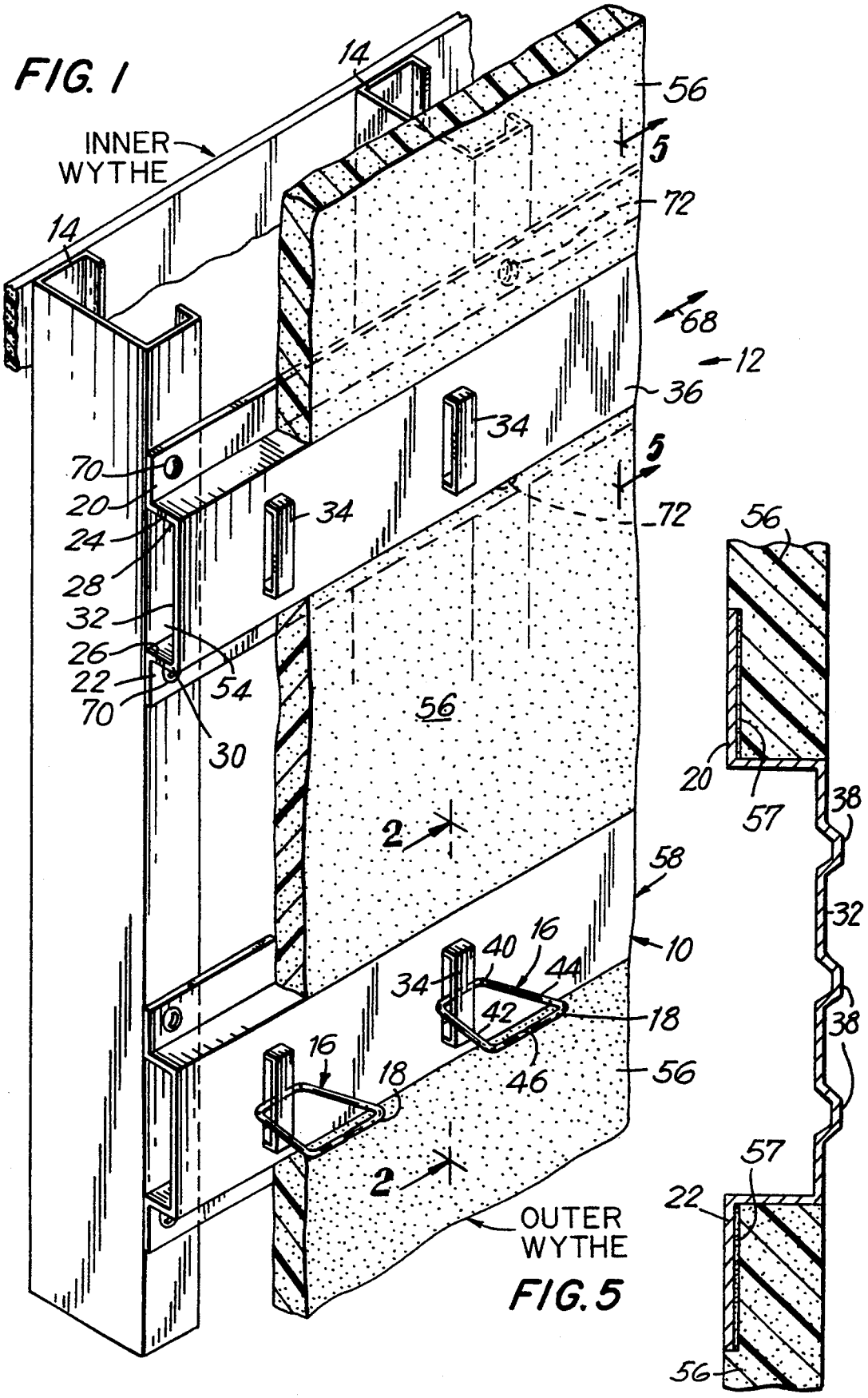
FIG. 1 is a partial perspective view of a drywall construction system fabricated in accordance with the principles of the present invention employing the new and novel multi veneer anchor structural assembly thereof.
FIG. 5 is a sectional view taken along the line 5—5 of FIG. 1 showing another alternative embodiment of the invention.

Referring to the drawings and more particularly to FIG. 1 thereof; there is depicted the new and novel drywall construction system denoted generally by the reference numeral 10 and fabricated in accordance with the principles of the present invention. The drywall construction system 10 employs the new and novel multi veneer anchor structural assembly generally denoted by the reference numeral 12. As is best seen in FIG. 1, the drywall construction system comprises a plurality of vertical channels 14, an insulating layer or wall board member 56, the multi veneer anchor structural assembly 12 and a plurality of wall ties 16. The vertical channels 14 form the framing members and inner wythe of an edifice.

The outer wythe, which is attached to the base portions 18 of the wall ties 16, is conventional in nature and has therefore not been shown. The outer wythe need also not be described in detail other than to indicate that may be constructed of bricks, cinderblocks, stone or other suitably similar masonry materials which have regular or irregular configurations and wherein the base portions 18 of the wall ties 16 are inserted into the masonry joints during the construction of the outer wythe.

The multi veneer anchor structural assembly 12 includes a pair of base portions or members 20,22 which are disposed in alignment along a common plane. A pair of substantially horizontal projecting portions or flange members 24,26 are connected to the base portions 20,22 with the outer ends 28,30 of the projecting portions being connected to a vertical plate portion or planar member 32. The vertical plate portion 32 includes a plurality of elongated and forwardly projecting vertical members 34 which are disposed in spaced apart and generally parallel relationship to the surface 36 of the vertical planar member 32.

The base portions 20,22 each have a plurality of bores 70,72 which are spaced in accordance with the spacing of standard framing members 14. The wall tie members 16 illustrated herein are formed of wire and have the general configuration of a trapezoid with generally parallel larger and smaller base portions 18 and 40, respectively, which are connected by side portions 42,44. The larger base portion 18 includes an opening 46 which facilitates attachment of the wall ties 16 to the vertical projecting bar members 34 and thus to the multi veneer anchor structural assembly 12. The length of the smaller base 40 approximates the width of the vertical members 34, thereby contributing to the lateral stability of the drywall construction system 10, according to the present invention. However, it is herein to be noted that other types of wall ties may also be suitably employed herein.

The vertical members 34 may be formed by a punching operation during the fabrication of the assembly 12. In an alternative embodiment of the invention, illustrated in FIG. 5, the vertical planar member 32 also includes a plurality of dimpled or locally deformed areas 38 which increase the stiffness of the vertical planar member 32. The configuration of the dimpled areas 38 is shown, by way of example, in FIG. 5 and it is understood that a broad range of dimple configurations may be utilized to achieve the desired stiffness of the vertical planar member 32.

Figure 2:
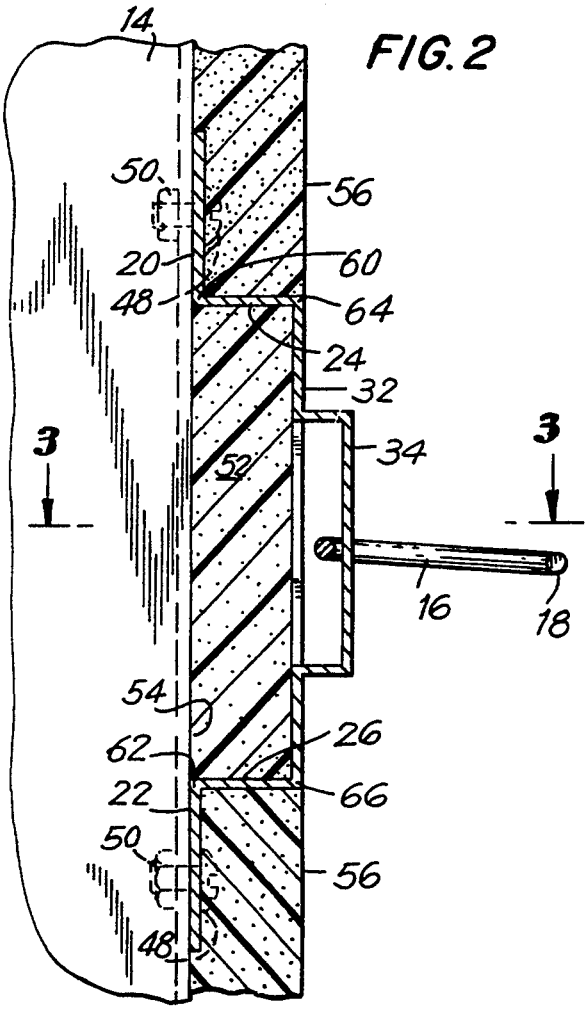
FIG. 2 is a sectional view taken along the line 2—2 of FIG. 1.
Figure 3:
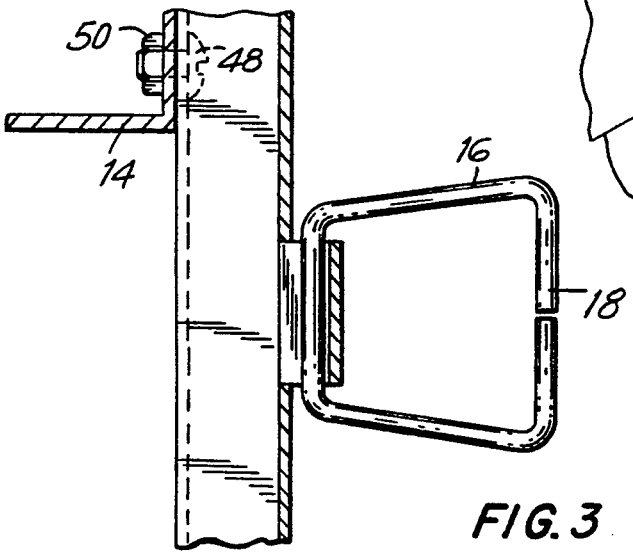
FIG. 3 is a sectional view taken on the line 3—3 of FIG. 2.

In use, the multi veneer anchor structural assembly 12 is attached to the vertical channel 14 by means of the screws 48 and nuts 50, as shown in FIGS. 2 and 3. Alternatively, self tapping screws or other fastening means may be used to attach the multiple veneer anchor structural assembly 12 to the vertical channels 14.

A strip of insulating material 52, which fills the space 54, defined by the projecting portions 24,26 and the vertical channels 14 may be inserted into the space 54. The addition of this strip of insulating material 52, in conjunction with the insulating layer 56, provides a complete layer of insulation between the inner and outer wythes. The insulating layer 56 is placed between adjacent ones of the multi veneer anchor structural assemblies 12. As illustrated in FIG. 1, the layer is disposed between an upper assembly and the identical multi veneer structural assembly 58, located below the multi veneer anchor assembly 12. The width of the flange members 24,26 approximates the thickness of the insulating layer 56 thereby ensuring that the insulating layer 56 is securely held between the adjacently disposed multi veneer anchor structural assemblies 12,58. A plurality of wall ties, each similar to the wall tie 16, is attached to the vertical members 34, as shown in FIGS. 1–4.

In the embodiment illustrated, the insulating layer 56 is proportioned so that it is force fitted between the multi veneer anchor structural assemblies 12,58. In an alternative embodiment, and as seen in FIG. 5, an adhesive layer 57 is used to attach the insulating layer 56 to the base members 20,22. It will be apparent to those skilled in the art that an adhesive layer may also be interposed between the inner surface of insulating layer 56 and the vertical channels 14 and may take the form of a double backed adhesive.

Figure 4:
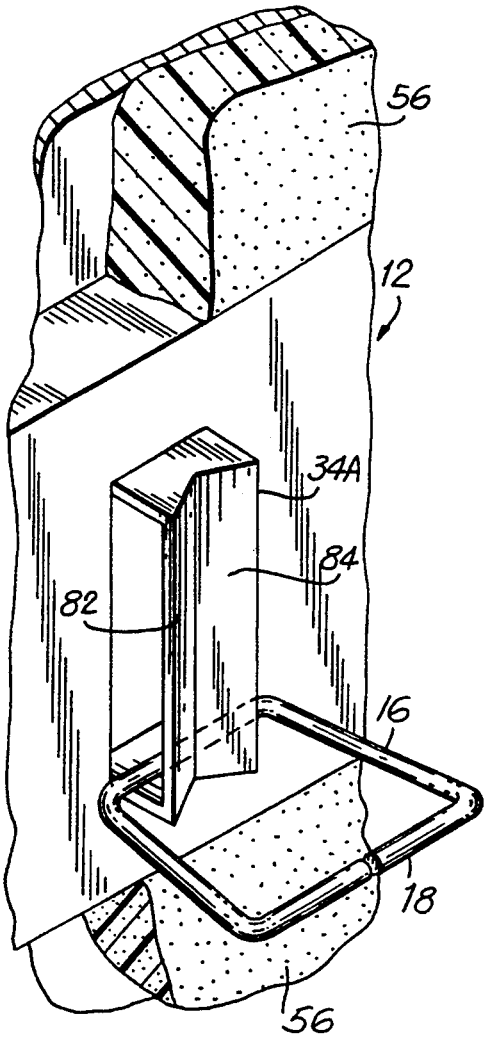
FIG. 4 is a partial perspective view of a portion of the drywall construction system of FIG. 1 drawn to an enlarged scale, showing an alternative embodiment of the invention.

FIG. 4 shows an alternative configuration of the vertical projecting bar member designated 34A. The configuration 34A includes a pair of angularly disposed plane portions 82,84.

In the preferred embodiment, the multi veneer anchor structural assembly 12 is fabricated of a single sheet of metal with the steps of fabrication including the relatively simple steps of forming the bends 60,62 between the base portions 20, 22 and the horizontally projecting portions 24,26, and the bends 64,66 between the flange members 24,26 and the vertical portion 32.

The high degree of stiffness of the multi veneer anchor structural assembly 12 in the lateral direction, indicated by the arrow 68 in FIG. 1, and the attachment of the multi veneer anchor structural assembly 12 to the vertical channels 14 provide a degree of rigidity to the drywall construction 10 according to the present invention which exceeds previous drywall construction systems.

Figure 6:
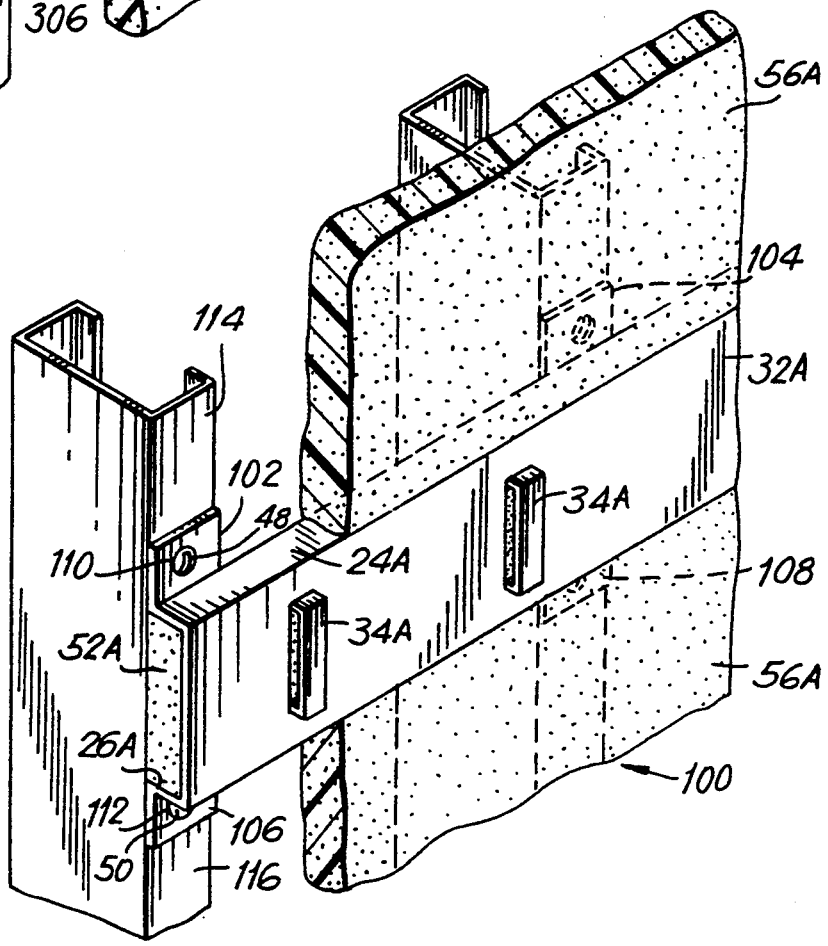
FIG. 6 is a partial perspective view of another alternative embodiment of the invention.

In an alternative embodiment of the invention denoted 100, shown in FIG. 6, the members 20,22 of FIGS. 1–5 are replaced by a plurality of spaced-apart mounting tabs 102,104,106,108 which are connected to the flange members 24A,26A. The mounting tabs 102,104,106,108 are spaced in accordance with the spacing of standard framing members 14. Each of the mounting tabs includes a bore, typically designated by the reference numerals 110,112 for attachment of the mounting tabs 102,104,106,108 to the framing members 14 using conventional connection means such as screws 48 and nuts 50, as shown in FIG. 2.

The vertical plate 32A includes a plurality of vertical bar members 34A which are similar to the vertical bar members 34 which have been previously described in connection with FIGS. 1–5.

An insulating strip 52A is inserted behind the vertical plate 32A in a manner similar to the insulating strip 52 shown in FIG. 2. An insulating layer 56A is utilized in a manner similar to the insulating layer 56. In the embodiment of FIG. 6, the insulating layer 56A may be attached to the framing members 14 through the use of an adhesive layer which is typically disposed on members 14 in the location designated by the reference numerals 114,116 in FIG. 6. The adhesive layer may be in the nature of a double sided adhesive film.

Figure 6A:
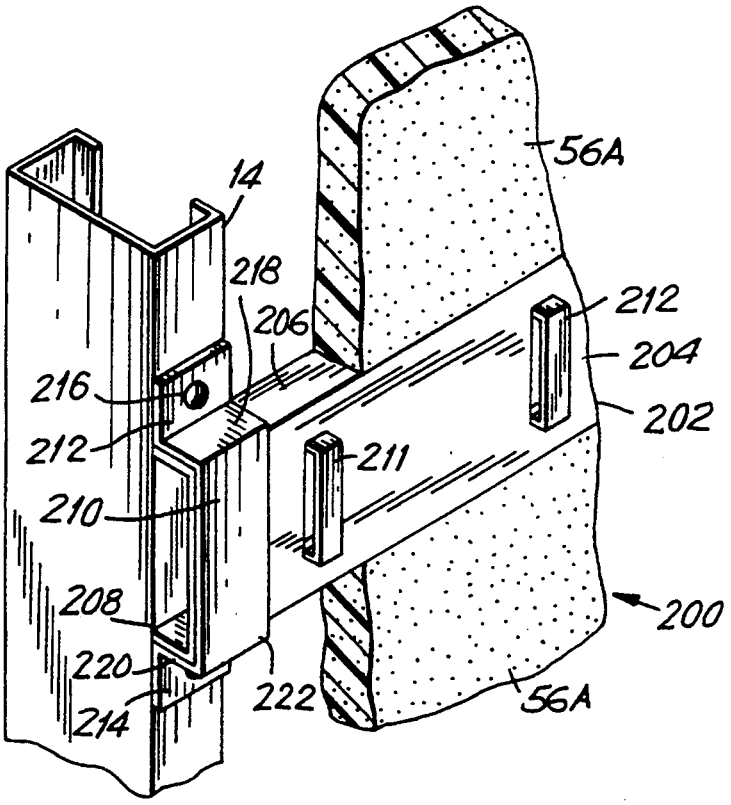
FIG. 6A is a partial perspective view of yet another alternative embodiment of the invention.

In another alternative embodiment of the invention shown in FIG. 6A and designated by the reference numeral 200, the mounting tabs 102,104,106,108 shown in FIG. 6 are removed and the channel member 202 which comprises a plate portion 204 and a pair of flange members 206,208, which are similar to the plate portion 32 and the flange members 24,26 of FIG. 1. are secured to the vertical channels 14 by a plurality of strap members 210. The plate portion 204 includes a plurality of vertical bar members 211 which are similar to the vertical bar members 34,34A of FIGS. 1 and 4.

The strap members 210 each have a pair of base portions 212,214 each of which include a bore 216 formed therein for attachment of the strap member 210 to the vertical channel 14. The members 210 include a pair of horizontal portions or flanges 218,220 and a vertical portion 222 which closely fit over the flange members 206,208 and the plate portion 204 of the channel member 202.

Figure 7:
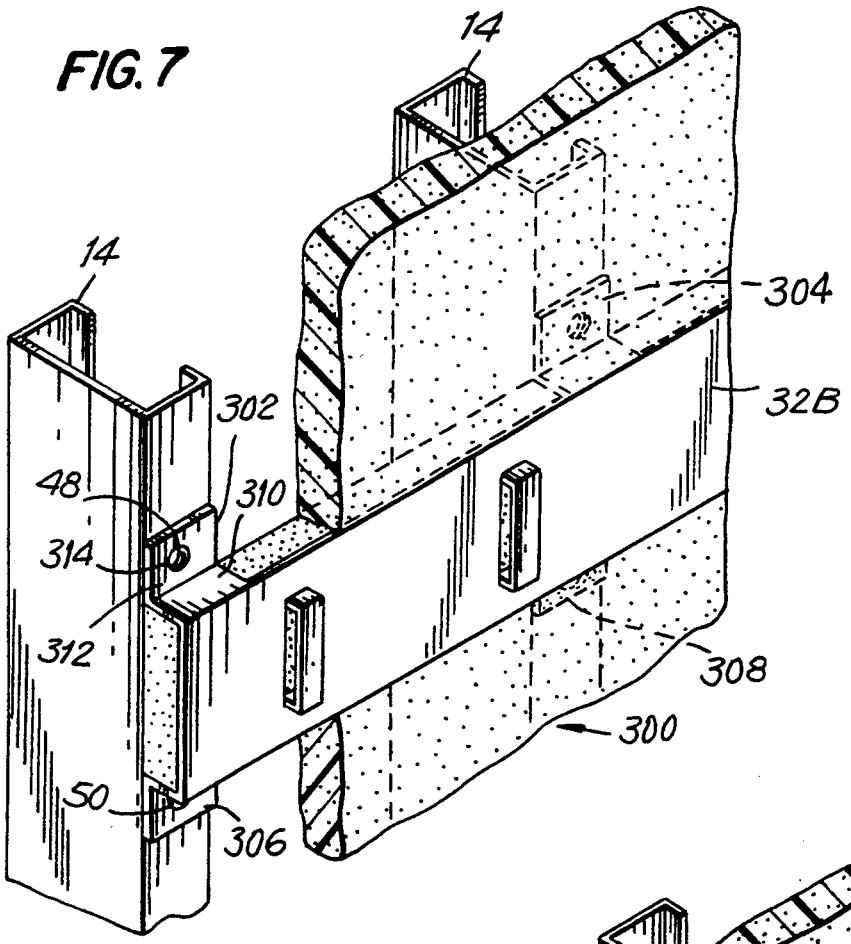
FIG. 7 is a partial perspective view of another alternative embodiment of the invention.

In an alternative embodiment of the invention shown in FIG. 7 and designated 300, both the base portions 20,22 and the flange members 24,26 of FIGS. 1–5 are replaced by a plurality of spaced apart mounting tabs 302,304,306,308 which are integrally formed with the vertical plate 32B. The mounting tabs 302,304,306,308 include a horizontal portion and a vertical portion typically designated by reference numerals 310 and 312, respectively, and a bore typically designated by the reference numeral 314. The mounting tabs 302,304,306,308 are spaced in accordance with the spacing of the standard framing members 14. The mounting tabs are attached to the framing members 14 using conventional screws 48 and nuts 50, of the type shown in FIG. 2.

Figure 8:
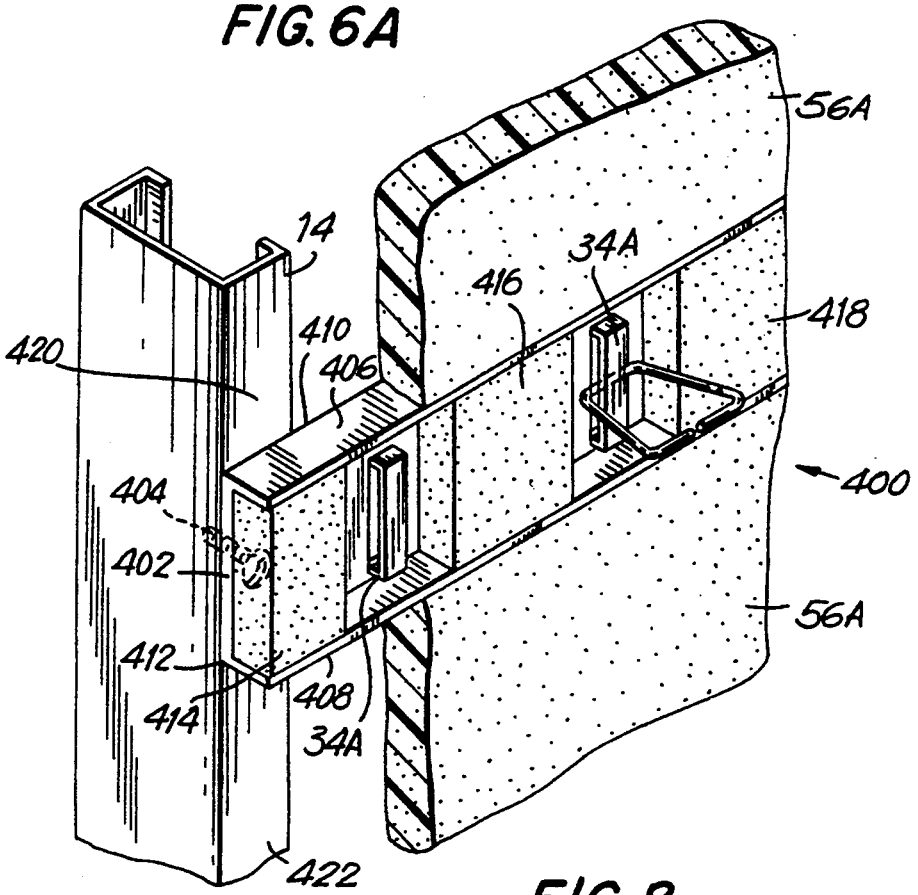
FIG. 8 is a partial perspective view of yet another alternative embodiment of the invention.

In another alternative embodiment of the invention shown in FIG. 8, denoted by the reference numeral 400, the plate portion 402, which is similar to the plate portion 32 of FIG. 1, is fastened directly to the vertical channel 14 using a plurality of screws such as illustrated by the reference numeral 404. The plate portion 402 includes a plurality of vertical bar members 34A of the type illustrated in FIG. 1. A plurality of wall tie members similar to the wall tie member 16 are mounted, one each, on the vertical bar members 34A.

A pair of flange members 406,408 are joined to upper and lower edges 410,412 of the plate portion 402 and provide a high degree of rigidity for the plate portion 402.

Individual blocks of insulating material 414,416,418 are disposed in an abutting relationship with the plate portion 402 and are disposed within the confines of flange members 406,408 between the horizontally adjacent ones of the vertical bar members 34A. In a manner similar to that which has been described in connection with FIG. 6, insulating layers 56A are provided between vertically adjacent ones of the veneer anchor structural assembly 400. The insulating layer 56A, as previously discussed, may be attached to the framing members 14 by means of a double backed adhesive layer secured to the layer 56A and the areas designated by the reference numerals 420,422 on the channels 14.

In another alternative embodiment of the invention, the system designated by the reference numeral 500 is shown in FIGS. 9 and 10. The base members 502,504 include a plurality of integrally formed tabs 506,508 which cooperate with apertures 520, 522 formed in channel members 14A with apertures 510,512 formed in the channel members 14A for securement of the base members 502,504 with respect to the channel members 14A. The tabs 506,508 are substantially parallel to and spaced apart from the base members 502,504 and may be formed by means of a punching and embossing operation during fabrication of the veneer anchor structural assembly 501. The base members 502,504 are formed integrally with horizontal portions 510,512 which are similar to the portions 24,26 of FIG. 1. The plate portion 514 is similar to the plate portion 32 of FIG. 1. The plate portion 514 includes vertical bar members (not shown) which are similar to the vertical bar member 34 of FIG. 1.

The tabs 506,508 are proportioned to abuttingly engage the surface 516 of the channel 14A thereby retaining and holding the base portions 502,504 against the channel 14A in a rigid and secure manner.

In another embodiment of the invention shown in FIGS. 11 through 13, the system 600 has the ends 602,604 of the base portions 606,608 keyed to form interlocking tabs 610,612,614,616. Each of the tabs includes a keyhole aperture 618,620,622,624 for attachment to a vertically positioned channel or frame member 626. The vertical channel includes a plurality of cap screws 628,630 the heads of which fit through the larger portion of the keyhole apertures 618,620,622,624 and the bodies of which fit into the smaller portion of the keyhole apertures 618,620,622,624.

The base portions 606,608 are keyed by providing a cut-out or space 632,634 between the tab portions 610,614 and the flange portions 636,638 on the left end of the assembly 640. On the right end of the assembly 640, the spaces 642,644 are disposed outwardly relative to the tabs 612,616. The spaces 632,634 on the left end of the assembly 640 are proportioned to accept the tab portions 612,616 on the right end of the assembly 640.

The veneer anchor assembly 640 includes plate portion 646 which has vertical bar members which are not shown in FIGS. 11–13, but which have been shown and described in detail in conjunction with FIG. 1.

In use, the base portions 606,608 are inserted onto cap screws 628,630 and then moved horizontally thereby moving the smaller portion of the keyhole apertures 618,620,622,624 onto the body portions of the cap screws. Thereafter, the cap screws 628,630 are tightened against the base portions 606,608.

Figure 14:
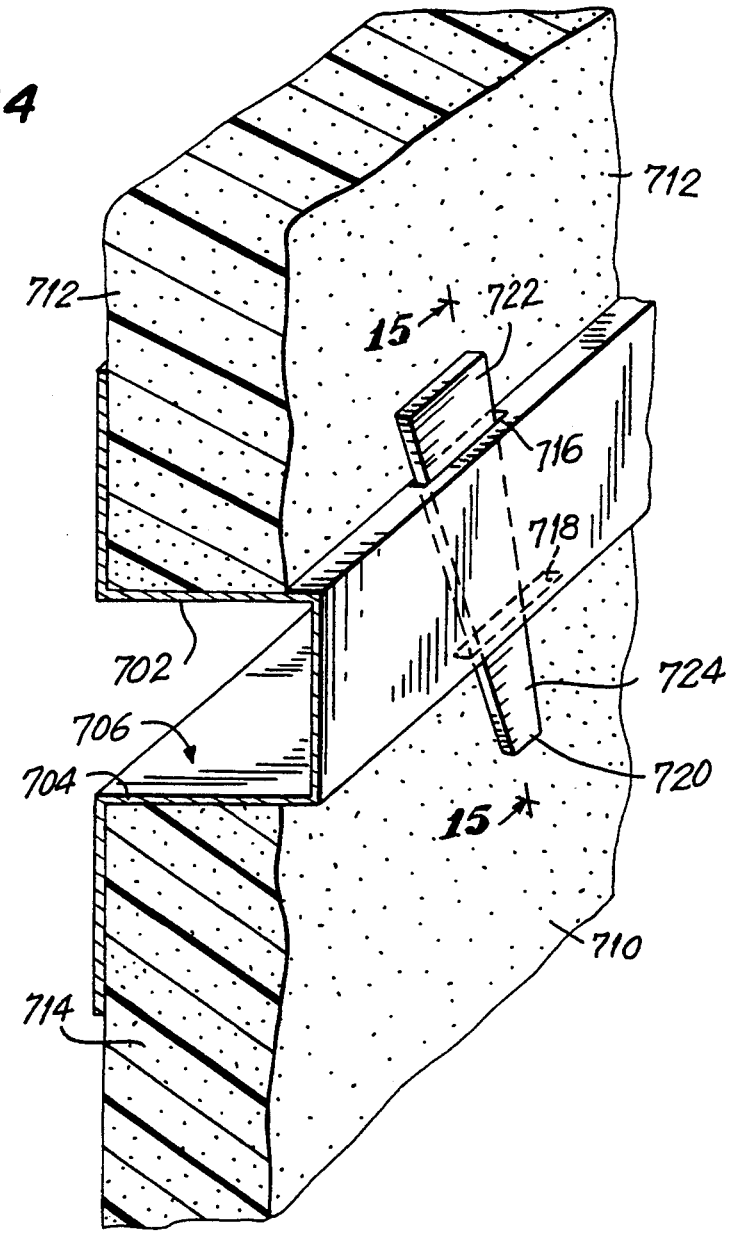
FIG. 14 is a partial perspective view of another alternative embodiment of the invention.
Figure 15:
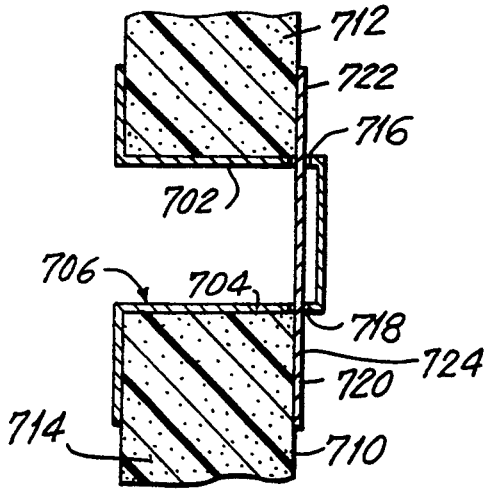
FIG. 15 is a cross-sectional view taken along the line 15—15 of FIG. 14.

Another alternative embodiment of the invention, designated 700, is shown in FIGS. 14 and 15. The horizontal portions 702,704 of the veneer anchor assembly 706 extend past the surfaces 708,710 of the insulation layers 712,714 and the horizontal portions 702,704 include apertures 716,718 into which locking members 720 are insertable. The locking member 720 may be in the nature of a trapezoid or of another suitable shape which may be inserted into the apertures 716,718 leaving upper and lower projecting portions 722,724, respectively, which hold the insulation layers 712,714 in place.

The channel member 706 is attached to the support members of an edifice and also includes projecting bar members for securement of wall ties in a manner which is similar to those shown and described in previous embodiments of the invention.

Figure 16:
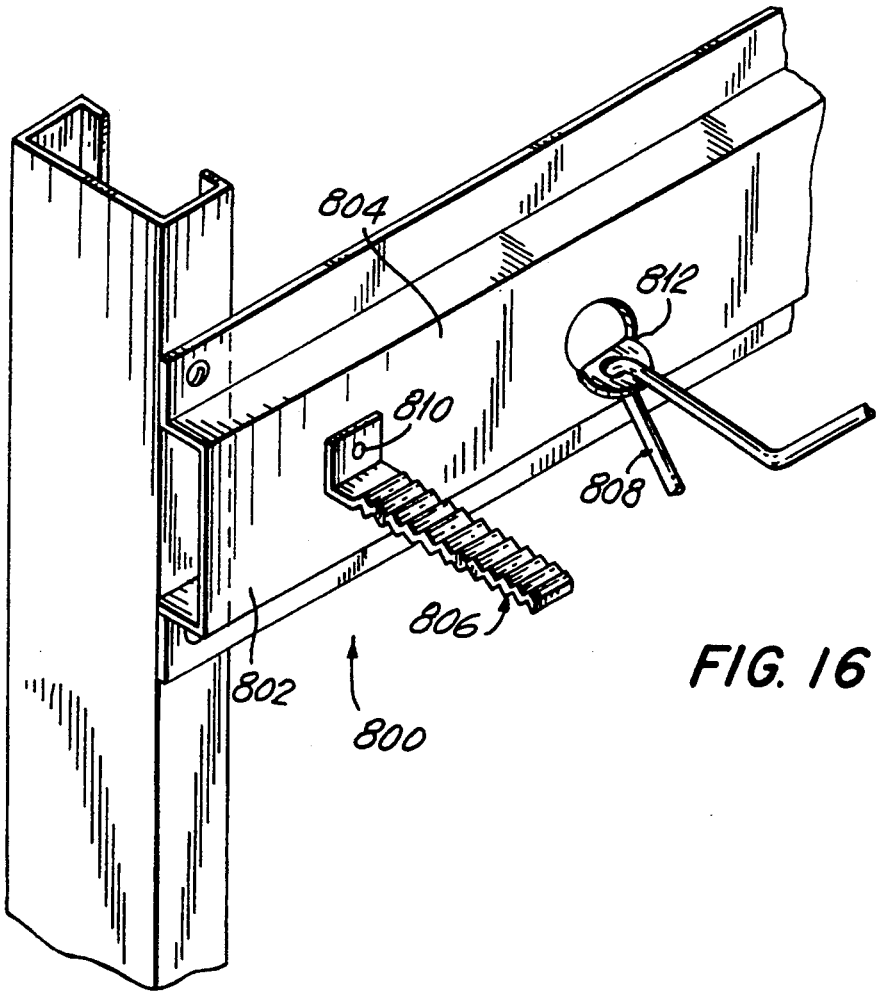
FIG. 16 is a partial perspective view of yet another embodiment of the invention.
Figure 17:
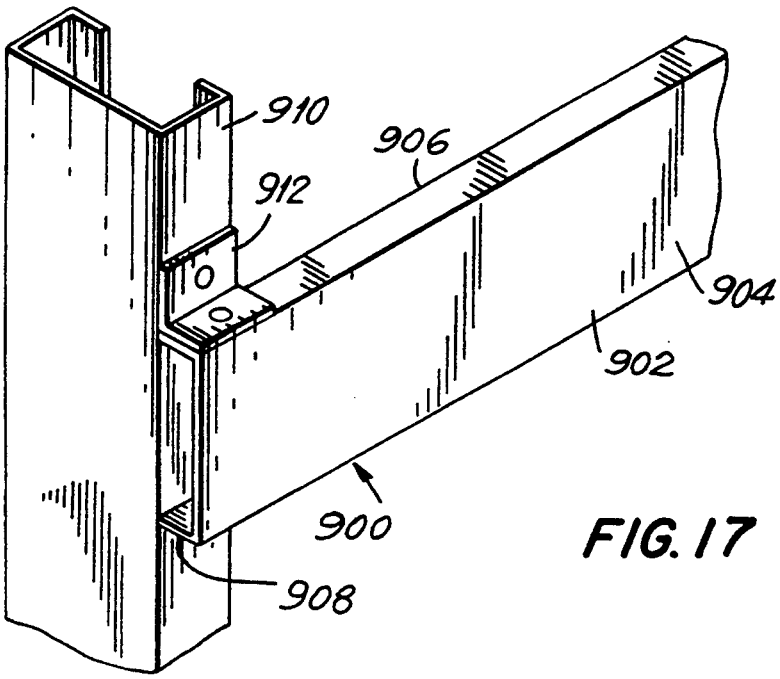
FIG. 17 is a partial perspective view of still another alternative embodiment of the invention.

In still another embodiment of the invention 800, shown in FIG. 16, the member 802 includes a plate portion 804 onto which wall ties 806,808 are attached by means of screw fasteners 810,812.

In yet another embodiment of the invention designated 900, the assembly 902 includes a plate portion 904 and a pair of flange portions 906,908 which abut the vertical channel 910. The member 902 is secured with respect to the channel 910 by means of clips, one of which is typically illustrated as the clip 912. The clip 912 may be secured to the flange 906 and the channel 910 by either screws or a welding operation.

It will be apparent from the foregoing discussion that the drywall construction systems 10,100,200,300,400, 500,600,700,800,900 will retain their structural integrity irrespective of the ultimate decay, deterioration or destruction of the insulating layers 52,56 or 52A,56A. In this regard, the wall ties 16 are prevented from having any appreciable horizontal or lateral movement by virtue of the, function of the vertical members 34, while the multi veneer anchor structural assembly 12 is prevented from horizontal movement by virtue of the direct and rigid connection of the base portions 20,22 and the vertical channels 14 or the other similar portions or members with respect to the other designated vertical channels.

The construction systems 10,100,200,300,400,500,600, 700,800,900 accordingly do not depend on the insulating layers 56,56A for rigidity in any respect, due to the inherent stiffness of the multi veneer anchor structural assemblies 12. The outer wythe is prevented from moving inwardly even if the insulating layers 56,56A are completely removed. This ultimate securement of the outer wythe to the channel members 14, forming the inner wythe, guarantees the structural integrity of the drywall construction systems by preventing premature deterioration of the outer wythe. This could occur if the outer wythe were capable of moving inwardly toward the inner wythe upon deterioration of the insulating layer or similarly disposed layer.

What I have provided is a new and novel multi veneer anchor structural assembly in conjunction with a drywall construction system which obviates problems which may occur or which are of concern in prior art systems and devices. In particular, the securement features of the wall ties in conjunction with the multi veneer anchor structural assembly guarantees the structural integrity of the outer wythe irrespective of the problems of displacement or deterioration which may occur to the insulation layers.

While I have shown and described the preferred embodiments of the invention, it will be readily apparent to those skilled in the art that there are changes, modifications and improvements which may be made therein without departing from the spirit and scope thereof as previoulsy defined and envisioned and as may hereinafter be claimed.

What is claimed is:

1. A structural assembly for securement between an inner wythe having a plurality of vertically disposed spaced apart support members, and art outer wythe of an edifice for residential/office use, said structural assembly comprising, in combination, at least two longitudinally extending channel assemblies formed substantially as a U, for extending between at least two of said vertically disposed support members and each channel assembly comprising an elongated planar member, having a longitudinally extending flange of predetermined depth attached at an end to each end edge of said planar member and a base member attached to a free end edge of each flange and arranged parallel to said planar member wherein said U is raised outwardly and bridges said base members so as to provide greater rigidity and structural integrity as compared to a flat plate-like member, a plurality of separate, individual spaced apart anchor members fixedly secured to said planar member and extending longitudinally along said planar member, means for securing said base members of said channel assembly to said vertically disposed support members of said inner wythe, means engaged to a plurality of said anchor members for individually securing said anchor members to said outer wythe by means of a plurality of wall ties; and sheet insulation supported at least in part by said flanges, and being substantially flush with each planar member of adjacently disposed channel assemblies.

2. A structural assembly in accordance with claim 1, wherein said means for securing said planar member to said inner wythe comprises fastening means for directly securing said planar member to said inner wythe.

3. A structural assembly in accordance with claim 1, wherein said planar member has a dimpled a cross-sectional configuration.

4. A structural assembly in accordance with claim 1 wherein said planar member, said flange members, and said base members are formed integrally with one another.

5. A structural assembly in accordance with claim 4, wherein said planar member has a dimpled cross-sectional configuration.

6. A structural assembly in accordance with claim 4, wherein said base members are disposed in spaced apart relationship with respect to said flange members.

7. A structural assembly in accordance with claim 4, wherein respective aligned portions of said flange and base members are disposed in spaced apart relationship with respect to said planar member.

8. A structural assembly in accordance with claim 1, wherein each of said base members has a plurality of spaced apart tab members formed thereon, and said tab members being capable of abutting engagement with said inner wythe to thereby provide securement of said base members with said inner wythe.

9. A structural assembly in accordance with claim 8, wherein said tab members project from the rear surface of said base members.

10. A structural assembly in accordance with claim 1, wherein each of said base members has a plurality of spaced apart apertures formed therein.

11. A structural assembly in accordance with claim 10, wherein said apertures have a substantially horizontally extending keyhole configuration.

12. In a drywall construction system for residential/orifice use having an outer wythe and an inner wythe, said inner wythe including a plurality of vertically disposed spaced apart support members forming the frame of an edifice, the improvement comprising a plurality of longitudinally extending adjacent spaced apart and substantially parallel channel assembly members formed generally as a U arranged transverse to said vertically disposed support members and each extending between at least two of said plurality of said vertically disposed support members, each of said channel assembly members comprising an elongated planar member with depending opposite side flanges of predetermined depth attached with each end edge of said planar member and a base member attached to a free end edge of said planar member and extending parallel to and outwardly from said planar member wherein said U is raised outwardly and bridges said base members so as to provide greater rigidity and structural integrity as compared to a flat plate-like member, and a plurality of means engaging each base members for securing said channel member to said vertically disposed support members of said inner wythe, a plurality of separate spaced apart anchor members fixedly secured to said planar member and extending longitudinally thereon and means for securing each of said anchor members to said outer wythe by menas of a plurality of wall ties; and a sheet dry wall supported at least in part by said flanges, and being substantially flush with each planar member of adjacently disposed channel assemblies.

13. A structural assembly in accordance with claim 12 wherein said anchor members are disposed in substantially parallel and planar relationship with respect to one another and in substantially parallel planar relationship with respect to said planar member.

14. A drywall construction system in accordance with claim 12, wherein said dry wall comprising an insulating member disposed between adjacent channel assembly members and being arranged in abutting engagement with said bases of said plurality of channel assembly members.

15. A drywall construction system in accordance with claim 14, including means for securing said insulating member to said support members.

16. A drywall construction system in accordance with claim 15, wherein said means for positionally securing said insulating sheet dry wall member comprises locking members, each of said flange members having a lateral dimension greater than the thickness of that of said insulating sheet dry wall member, each of said flange members having a plurality of spaced apart apertures formed therein proximate the end thereof connected to said planar member, said apertures being disposed in vertically aligned pairs, and each of said locking members projecting vertically through one of said vertically aligned pairs of said apertures.

17. A drywall construction system in accordance with claim 16, wherein each of said base members has a plurality of spaced apart tab members formed thereon, said tab members projecting rearwardly from the rear surface of said base members and being disposed in planar spaced apart parallel relationship with respect to said base members, said vertically disposed support members having a plurality of horizontally formed slots disposed in vertically spaced apart relationship, said tab members being capable of mating insertion into respective ones of said horizontally formed slots, and said mating insertion being capable of securing said base members with respect to said support members and thereby said inner wythe.

18. A drywall construction system in accordance with claim 16, wherein each of said base members have spaced apart ends, said ends of said base members having tab members formed thereat, said tab members being disposed in vertically offset relationship with respect to one another, said tab members of adjacent ones of said base members being disposed in interlocking relationship, each of said tab members having at least one aperture formed therein, each of said vertically disposed support members having a plurality of vertically spaced apart post members secured thereto, said post members having head portions, and said base members being interlockingly securable to said vertical support members by insertion of said head portions of said post members through said apertures.

19. A drywall construction system in accordance with claim 18, wherein said apertures extend horizontally and have substantially keyhole configurations, said post members having enlarged head portions, which project through said apertures, and said base members being capable of horizontal slidably locking engagement upon said post members.

20. A drywall construction system in accordance with claim 14, wherein said drywall comprising an insulating member disposed between adjacent channel assembly members and being arranged in abutting engagement with said side flanges of said plurality of channel assembly members.

21. A drywall construction system in accordance with claim 20, including means for securing said insulating member to said side flanges.

22. A drywall construction system in accordance with claim 12, wherein said anchor members are formed integrally with and project outwardly from said planar member away from said inner wythe.

23. A drywall construction system in accordance with claim 22, wherein said anchor members are disposed substantially parallel with respect to one another.

24. A drywall construction system in accordance with claim 12, wherein said planar member has a dimpled cross-sectional configuration.

25. A structural element in the form of abutting end to end longitudinally extending channel assemblies for use in the construction of an edifice, each said channel assembly comprising a longitudinally extending planar member, a pair of longitudinally extending flange members, and a pair of longitudinally extending base members, said flange members being disposed and space apart parallel relationship and being of predetermined depth to enable insulation placed thereagainst to be supported thereon at least in part, and to be substantially flush with each of said planar members; and each said flange members of a channel assembly having one of the ends thereof connected to said planar member and the other of the ends thereof connected to a respective one of said base members, said base members being in a common plane and disposed parallel to said planar member, said flange members being disposed in substantially perpendicular relationship with respect to said planar member and said base members, and each said planar member having a plurality of integrally formed spaced apart anchor members fixedly secured thereto extending longitudinally and projecting outwardly therefrom in a direction away from said base members to form receiving apertures for use with a plurality of wall ties.

26. A structural element in accordance with claim 25, wherein said anchor members are disposed substantially in a common plane and the common plane of said anchors and the planar member being parallel.

27. A structural element in accordance with claim 26 wherein said planar member, said flange members, said base members as well as said anchors are formed integrally with one another.

28. A structural element in accordance with claim 27, wherein said planar member has a dimpled cross-sectional configuration.

29. A structural element in accordance with claim 25, wherein said anchor members are vertically disposed.

30. A structural element in accordance with claim 29, wherein each said anchor member forms generally a U-shaped channel protruding out from said planar member, with a passageway between said planar member and said U-shaped channel for accommodating a said wall tie in said passageway.

31. A structural element in accordance with claim 25, wherein said anchor members are parallel to each other.

32. A structural element in accordance with claim 25, wherein said anchor members project outwardly a predetermined distance so as to form receiving apertures to accommodate said wall ties in said receiving apertures between said planar member and the projecting anchor members.

33. A structural element in accordance with claim 25, wherein said planar member secured to said anchor members extending therebetween in a manner that enables a plurality of planar members to abut one another end to end from substantially center to substantially center of said anchor members.

* * * * *